US011156387B2

(12) United States Patent
Hirayama

(10) Patent No.: US 11,156,387 B2
(45) Date of Patent: Oct. 26, 2021

(54) CRYOCOOLER AND CONTROL DEVICE OF CRYOCOOLER

(71) Applicant: SUMITOMO HEAVY INDUSTRIES, LTD., Tokyo (JP)

(72) Inventor: Takashi Hirayama, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 144 days.

(21) Appl. No.: 16/426,800

(22) Filed: May 30, 2019

(65) Prior Publication Data

US 2019/0277541 A1 Sep. 12, 2019

Related U.S. Application Data

(63) Continuation of application No. PCT/JP2017/044951, filed on Dec. 14, 2017.

(30) Foreign Application Priority Data

Jan. 16, 2017 (JP) ..... JP2017-005024

(51) Int. Cl.
*F25B 9/00* (2006.01)
*F25B 9/14* (2006.01)
*F25B 49/02* (2006.01)

(52) U.S. Cl.
CPC ..... *F25B 9/00* (2013.01); *F25B 9/14* (2013.01); *F25B 9/145* (2013.01); *F25B 49/02* (2013.01); *F25B 2309/1427* (2013.01); *F25B 2309/14181* (2013.01)

(58) Field of Classification Search
CPC .... F25B 9/00; F25B 9/14; F25B 9/145; F25B 49/02; F25B 2309/14181; F25B 2309/1427; F25B 2500/27
USPC ..... 62/6
See application file for complete search history.

(56) References Cited

FOREIGN PATENT DOCUMENTS

| | | | |
|---|---|---|---|
| JP | H03-075456 A | | 3/1991 |
| JP | H0375456 A | * | 3/1991 |
| JP | H06-272979 A | | 9/1994 |
| JP | 2005-024239 A | | 1/2005 |
| JP | 2005-207632 A | | 8/2005 |

OTHER PUBLICATIONS

International Search Report issued in Application No. PCT/JP2017/044951, dated Mar. 6, 2018.

* cited by examiner

*Primary Examiner* — Steve S Tanenbaum
(74) *Attorney, Agent, or Firm* — Michael Best & Friedrich LLP

(57) ABSTRACT

A cryocooler includes a cold head, a valve unit which includes a rotary valve configured to periodically switch a pressure of a working gas in the cold head between a first high pressure and a second high pressure lower than the first high pressure and a valve motor configured to rotate the rotary valve, the valve unit having a rotation angle range in which the rotary valve seals the working gas having the second high pressure in the cold head, a cryocooler control unit configured to control the valve motor, a cryocooler stop instruction unit configured to output a cryocooler stop instruction signal to the cryocooler control unit, and a valve stop timing control unit configured to control the valve motor to stop the rotary valve in the rotation angle range, according to the cryocooler stop instruction signal.

10 Claims, 4 Drawing Sheets

CRYOCOOLER AND CONTROL DEVICE OF CRYOCOOLER

RELATED APPLICATIONS

The contents of Japanese Patent Application No. 2017-005024, and of International Patent Application No. PCT/JP2017/044951, on the basis of each of which priority benefits are claimed in an accompanying application data sheet, are in their entirety incorporated herein by reference."

BACKGROUND

Technical Field

Certain embodiments of the present invention relate to a cryocooler and a control device of a cryocooler.

Description of Related Art

A pulse tube cryocooler is known, in which a valve unit of the pulse tube cryocooler can be removed when maintenance of the valve unit is performed.

SUMMARY

According to an embodiment of the present invention, there is provided a cryocooler including: a cold head; a valve unit which includes a rotary valve configured to periodically switch a pressure of a working gas in the cold head between a first high pressure and a second high pressure lower than the first high pressure and a valve motor configured to rotate the rotary valve, the valve unit having a rotation angle range in which the rotary valve seals the working gas having the second high pressure in the cold head, a cryocooler control unit configured to control the valve motor; a cryocooler stop instruction unit configured to output a cryocooler stop instruction signal to the cryocooler control unit; and a valve stop timing control unit configured to control the valve motor to stop the rotary valve in the rotation angle range, according to the cryocooler stop instruction signal.

According to another embodiment of the present invention, there is provided a control device of a cryocooler, the cryocooler including, a cold head, a valve unit which includes a rotary valve configured to periodically switch a pressure of a working gas in the cold head between a first high pressure and a second high pressure lower than the first high pressure and a valve motor configured to rotate the rotary valve, the valve unit having rotation angle range in which the rotary valve seals the working gas having the second high pressure in the cold head, a cryocooler control unit configured to control the valve motor, and a cryocooler stop instruction unit configured to output a cryocooler stop instruction signal to the cryocooler control unit, the control device including: a valve stop timing control unit configured to control the valve motor to stop the rotary valve in the rotation angle range, according to the cryocooler stop instruction signal, in which the valve stop timing control unit is detachably configured between the valve motor and the cryocooler control unit.

DETAILED DESCRIPTION

Figure 1:
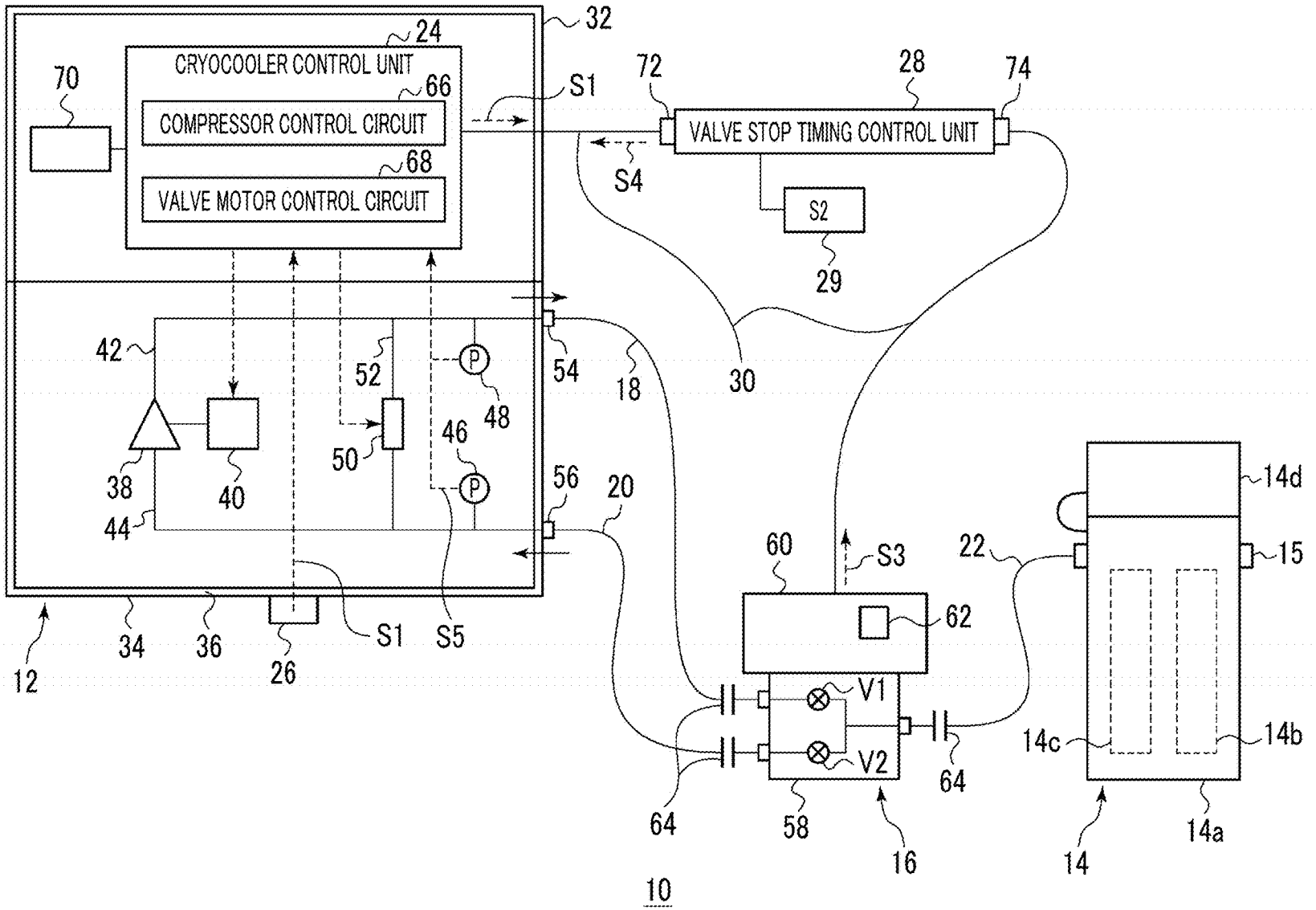
FIG. 1 is a diagram schematically showing an entire configuration of a cryocooler according to a first embodiment.

It is desirable to decrease risk so as to secure safety when maintenance of a cryocooler is performed.

In addition, aspects of the present invention include arbitrary combinations of the above-described elements and mutual substitution of elements or expressions of the present invention among apparatuses, methods, systems, or the like.

According to the present invention, it is possible to decrease risk so as to secure safety when a maintenance of a cryocooler is performed.

Hereinafter, embodiments of the present invention will be described in detail with reference to the drawings. Moreover, in descriptions thereof, the same reference numerals are assigned to the same elements, and repeated descriptions thereof are appropriately omitted. Moreover, configurations described below are illustrative and do not limit the scope of the present invention. In addition, in the drawings referred to the following descriptions, a size and a thickness of each component are for convenience of description, and do not necessarily indicate actual dimensions and ratios.

Figure 2:
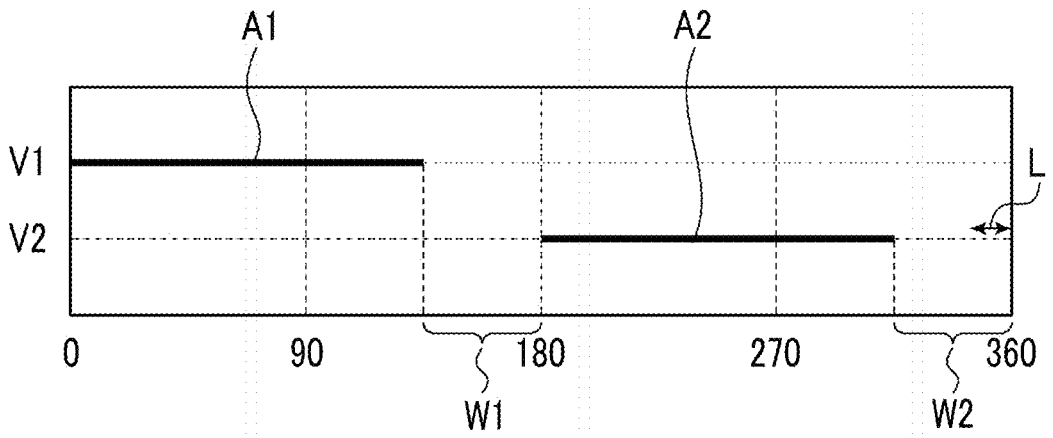
FIG. 2 is a diagram exemplifying a valve timing of the cryocooler.

FIG. 1 is a diagram schematically showing an entire configuration of a cryocooler according to a first embodiment. FIG. 2 is a diagram exemplifying a valve timing of the cryocooler.

During a cooling operation in the cryocooler, a working gas having a first high pressure is supplied from a compressor to a cold head. The working gas is depressurized from the first high pressure to a second high pressure which is lower than the first high pressure by adiabatic expansion in the cold head. The working gas having the second high pressure is recovered from the cold head to the compressor. The compressor compresses the recovered working gas having the second high pressure. The working gas is again booted to the first high pressure. In this way, the high pressure working gas circulates between the compressor and the cold head.

In general, the first high pressure and the second high pressure are higher than the atmospheric pressure. For convenience of explanation, the first high pressure and the second high pressure are referred to a high pressure and a low pressure, respectively. Typically, for example, the high pressure is 2 to 3 MPa. For example, the low pressure is 0.5 to 1.5 MPa, and for example, is approximately 0.8 MPa. For example, the working gas is a helium gas.

Maintenance is performed on the cryocooler regularly. Before the maintenance is performed, a cooling operation is stopped. By stopping the compressor, a pressure of the working gas inside the cryocooler becomes an average pressure between the high pressure and the low pressure. For example, the average pressure is approximately 1.5 MPa. Moreover, a temperature of a low temperature end of the cold head when the operation stops is a normal cooling temperature of the cryocooler. For example, this cooling temperature is a cryogenic temperature such as approximately 4K.

In a typical maintenance procedure, first, the cold head is heated from the cryogenic temperature to the room temperature. In addition, a component such as a valve unit is removed. The maintenance of the component is performed through the above-described preparation steps. A high pressure gas in the cold head is heated from the cryogenic temperature to the room temperature, and thus, the high pressure gas is further boosted. As in the above-described example, in a case where a cold head internal pressure is an average pressure of approximately 1.5 MPa and a low temperature end temperature is approximately 4K, the cold head is boosted to a pressure of approximately 4 MPa at the room temperature of approximately 300K.

The removal of the component may be performed in a state where the temperature of the cold head is the cryogenic temperature. In this case, the temperature of the cold head naturally increase during the maintenance work, and thus, the gas pressure in the cold head increases.

The cold head can be designed to withstand the assumed high pressure. In addition, measures such as installing a safety valve in the cold head are also possible. However, from the viewpoint of decreasing risk so as to secure safety during maintenance, it is preferable to avoid excessive boosting of the cold head.

Accordingly, in the cryocooler of the embodiment, as described below, the cooling operation stops when the pressure of the working gas in the cold head is the low pressure. In other words, when the cryocooler is instructed to stop the cooling operation, the cryocooler does not immediately stop the operation. The cryocooler is continuously operated to a timing when the pressure of the working gas in the cold head is the low pressure, and the operation of the cryocooler is stopped at the timing.

As in the above-described example, in a case where the cold head internal pressure is a low pressure of approximately 0.8 MPa and the low temperature end temperature is approximately 4K, the cold head is boosted to a pressure of approximately 2 MPa at the room temperature of approximately 300K. However, this is reduced to approximately half the pressure compared to a case where the cold head internal pressure is an average pressure of approximately 1.5 MPa. The cold head internal pressure during maintenance can be maintained at a relatively low pressure, for example a pressure lower than an opening pressure of the safety valve.

As shown in FIG. 1, the cryocooler 10 includes a compressor 12, a cold head 14, a valve unit 16, a high pressure pipe 18, a low pressure pipe 20, and an intake/exhaust pipe 22. In addition, the cryocooler 10 includes a cryocooler control unit 24, a cryocooler stop instruction unit 26, a valve stop timing control unit 28, and a power source line 30.

The compressor 12 includes a compressor control board 32, a compressor main body 34 which is controlled by the compressor control board 32, and a compressor housing 36. The compressor main body 34 includes a compression capsule 38, a compressor motor 40, a high pressure flow path 42, a low pressure flow path 44, a first pressure sensor 46, a second pressure sensor 48, a bypass valve 50, a bypass flow path 52, a high pressure gas outlet 54, and lower pressure gas inlet 56.

The compressor housing 36 accommodates the compression capsule 38, the compressor motor 40, the high pressure flow path 42, the low pressure flow path 44, the first pressure sensor 46, the second pressure sensor 48, the bypass valve 50, and the bypass flow path 52. The cryocooler stop instruction unit 26, the high pressure gas outlet 54, and the lower pressure gas inlet 56 are attached to an outer surface of the compressor housing 36. The compressor control board 32 is attached to the outer surface of the compressor housing 36 or is accommodated in the compressor housing 36.

The compression capsule 38 is configured to be driven by the compressor motor 40 so as to compress the working gas. The lower pressure gas inlet 56 is connected to a suction port of the compression capsule 38 via the low pressure flow path 44, and the high pressure gas outlet 54 is connected to a discharge port of the compression capsule 38 via the high pressure flow path 42. The first pressure sensor 46 is provided in the low pressure flow path 44 to measure a pressure of a low pressure working gas, and the second pressure sensor 48 is provided in the high pressure flow path 42 to measure a pressure of a high pressure working gas.

The bypass valve 50 is provided in the bypass flow path 52 for pressure equalization between a high pressure side and a low pressure side when the cooling operation of the cryocooler 10 is stopped. For example, the bypass valve 50 is a normally open solenoid valve, which is closed by energization during the cooling operation of the cryocooler 10 and is opened when the cooling operation is stopped. The bypass flow path 52 connects the high pressure flow path 42 to the low pressure flow path 44 so as to bypass the compression capsule 38.

For example, the cryocooler 10 is a pulse tube cryocooler, and the cold head 14 includes a cold head main body 14*a* including a pulse tube 14*b* and a regenerator 14*c* and a buffer tank 14*d* which is integrally with or separately from the cold head main body 14*a* and is fluidly connected to the cold head main body 14*a*. In addition, the cold head main body 14*a* may be provided with a safety valve 15 for releasing the excessive internal pressure of the working gas to the outside.

The valve unit 16 includes a rotary valve 58 and a valve motor 60 which rotates the rotary valve 58. The valve motor 60 may include a rotation angle sensor 62 such as an encoder for measuring a rotation angle of the valve motor 60. Since the valve unit 16 is configured such that the rotation angle of the valve motor 60 and a rotation angle of the rotary valve 58 coincide with each other, the rotation angle sensor 62 is considered to measure the rotation angle of the rotary valve 58.

The compressor 12, the cold head 14, and the valve unit 16 are disposed apart from each other, and the compressor 12 and the cold head 14 are fluidly connected to each other via the valve unit 16. The high pressure gas outlet 54 of the compressor main body 34 and the rotary valve 58 are connected to each other by the high pressure pipe 18, and the lower pressure gas inlet 56 of the compressor main body 34 and the rotary valve 58 are connected to each other by the low pressure pipe 20. The cold head main body 14*a* and the rotary valve 58 are connected to each other by the intake/exhaust pipe 22. The high pressure pipe 18, the low pressure pipe 20, and the intake/exhaust pipe 22 are all flexible pipes. However, at least one thereof may be a rigid pipe.

A removable fluid coupling 64 such as a self-sealing coupling may be provided in a middle of each of the high pressure pipe 18, the low pressure pipe 20, and the intake/exhaust pipe 22. Therefore, the valve unit 16 is removably connected from the compressor 12 and is also removably connected from the cold head 14. An operator removes the valve unit 16 from the compressor 12 and the cold head 14 and can perform maintenance. Alternatively, the operator can remove the valve unit 16 from the compressor 12 and the cold head 14 and replace the valve unit 16 with another valve unit which is new or is subjected to the maintenance.

The rotary valve 58 is configured to be able to periodically switch the pressure of the working gas in the cold head 14 between the first high pressure (high pressure) and the second high pressure (low pressure). For example, the rotary valve 58 includes a stationary valve main body and a valve disc which is rotated relative to the valve main body by the valve motor 60, and periodically switches the working gas pressure in the cold head 14 by a rotation of the valve disc relative to the valve main body.

As schematically shown in FIG. 1, the rotary valve 58 includes an intake valve V1 and an exhaust valve V2, and the two valves are selectively and alternately opened and closed. According to the rotation angle of the rotary valve 58, only the intake valve V1 is opened, or only the exhaust valve V2 is opened, or both the intake valve V1 and the exhaust valve V2 are closed. The intake valve V1 and the exhaust valve V2 are not opened at the same time.

The intake valve V1 and the exhaust valve V2 are connected from the valve unit 16 to a high temperature end of the regenerator 14*c* through the intake/exhaust pipe 22. The rotary valve 58 can adopt various known configurations. As is known, the rotary valve 58 may further include a high pressure valve V3 (not shown) and a low pressure valve V4 (not shown). The high pressure valve V3 and the low pressure valve V4 are connected from the valve unit 16 to a high temperature end of the pulse tube 14*b* through a single pipe similar to the intake/exhaust pipe 22. The rotary valve 58 may further include other valves.

For example, in a case where the cryocooler 10 is a pulse tube cryocooler, the high pressure valve V3 and the low pressure valve V4 are used for a phase control of gas displacement and pressure oscillation in the pulse tube 14*b*. The pulse tube cryocooler is also referred to as a four-valve pulse tube cryocooler. In a case where the cryocooler 10 is a gas driven GM cryocooler, the high pressure valve V3 and the low pressure valve V4 are used to control a gas pressure acting on a drive piston which drives a displacer.

FIG. 2 shows a valve timing of the rotary valve 58. One rotation of the rotary valve 58, that is, one period of the refrigeration cycle of the cryocooler 10 is divided into an intake step A1, a first waiting period W1, an exhaust step A2, and a second waiting period W2. In FIG. 2, the refrigeration cycle of one period is shown in association with 360°, and thus, 0° corresponds to a start time point of the period and 360° corresponds to an end time point of the period. 90°, 180°, and 270° correspond to a quarter period, a half period, and a ¾ period, respectively.

In the intake step A1, the intake valve V1 is opened. The exhaust valve V2 is closed. The high pressure pipe 18 communicates with the intake/exhaust pipe 22 through the rotary valve 58, and the compressor 12 supplies the high pressure working gas to the cold head 14.

The first waiting period W1 is after the intake step A1 and before the exhaust step A2. In the first waiting period W1, both the intake valve V1 and the exhaust valve V2 are closed, and the cold head 14 is fluidly disconnected from the compressor 12. The working gas having the first high pressure is sealed in the cold head 14 by the rotary valve 58.

In the exhaust step A2, the exhaust valve V2 is opened. The intake valve V1 is closed. The low pressure pipe 20 communicates with the intake/exhaust pipe 22 through the rotary valve 58, the working gas is recovered from the cold head 14 to the compressor 12, and the cold head 14 is stepped down to the second high pressure.

The second waiting period W2 is after the exhaust step A2 and before the intake step A1 (of the next refrigeration cycle). In the second waiting period W2, both the intake valve V1 and the exhaust valve V2 are closed, and the cold head 14 is fluidly disconnected from the compressor 12. The working gas having the second high pressure is sealed in the cold head 14 by the rotary valve 58 throughout the entire second waiting period W2.

Even in a case where the rotary valve 58 has other valves (for example, the high pressure valve V3 and the low pressure valve V4), all the valves are closed in at least a portion of the second waiting period W2, and the cold head 14 is fluidly disconnected from the compressor 12. Hereinafter, a period when the working gas having the second high pressure is sealed in the cold head 14 by the rotary valve 58 is also referred to as a low pressure gas sealing period L. That is, at least a portion of the second waiting period W2 corresponds to the low pressure gas sealing period L. In general, the low pressure gas sealing period L is a second half or a last stage of the second waiting period W2. The low pressure gas sealing period L ends immediately before the intake step A1.

In this way, the valve unit 16 has a rotation angle range in which the rotary valve 58 seals the working gas having the second high pressure in the cold head 14. As described later, the valve stop timing control unit 28 may determine a stop timing of the valve motor 60 such that the rotary valve 58 stops in the rotation angle range, based on a rotation angle measured by the rotation angle sensor 62. Alternatively, the valve stop timing control unit 28 may determine the stop timing of the valve motor 60 such that the rotary valve 58 stops in this rotation angle range, based on the pressure measured by the pressure sensor (for example, the first pressure sensor 46 and/or the second pressure sensor 48).

A control device of the cryocooler 10 including the cryocooler control unit 24 and the valve stop timing control unit 28 is realized by an element and a circuit such as a CPU and memory of a computer as a hardware configuration, and is realized by a computer program or the like as a software configuration. However, in FIG. 1, functional blocks realized by cooperation of them are appropriately shown. It is understood by those skilled in the art that the functional blocks can be realized in various forms by a combination of hardware and software.

The cryocooler control unit 24 is provided in the compressor control board 32, and thus, is built in the compressor 12. However, the cryocooler control unit 24 may be provided separately from the compressor 12. The cryocooler control unit 24 is configured to control the cryocooler 10, specifically, the compressor main body 34 and the valve motor 60.

The cryocooler control unit 24 includes a compressor control circuit 66 which controls the compressor motor 40 and the bypass valve 50, and a valve motor control circuit 68 which controls the valve motor 60. The cryocooler control unit 24, for example, the compressor control circuit 66 and/or the valve motor control circuit 68 are communicably connected to the valve stop timing control unit 28. In addition, the cryocooler control unit 24 is electrically connected to the cryocooler stop instruction unit 26, the first pressure sensor 46, the second pressure sensor 48, the rotation angle sensor 62, and other devices to receive signals input from them.

For example, the cryocooler stop instruction unit 26 is provided with a manually operable operation tool such as a stop button or a switch installed in the compressor main body 34, and is configured to output a cryocooler stop instruction signal S1 to the cryocooler control unit 24 when the operation tool is operated. The cryocooler control unit 24 is configured to transmit the received cryocooler stop instruction signal S1 to the valve stop timing control unit 28.

The cryocooler control unit 24 is electrically connected to the valve motor 60 by the power source line 30. The valve motor 60 receives power supplied from the compressor 12 through the power source line 30. In addition, the power source line 30 may be configured to enable communication between the cryocooler control unit 24 and the valve motor 60, and even if transmission and reception of signals for the control of the valve motor 60 by the cryocooler control unit 24 may be performed through the power source line 30.

The valve stop timing control unit 28 is detachably configured between the valve motor 60 and the cryocooler control unit 24. For example, the valve stop timing control unit 28 may be a control circuit such as a programmable logic controller (PLC). The valve stop timing control unit 28 may include a first connector 72 which is connectable to the cryocooler control unit 24 and a second connector 74 which is connectable to the valve motor 60. The first connector 72 is connected to the cryocooler control unit 24 through the power source line 30, and the second connector 74 is connected to the valve motor 60 through the power source line 30. For example, the valve stop timing control unit 28 is portable to the operator in the form of a maintenance kit, and can be connected to or removed from the power source line 30 as needed.

The valve stop timing control unit 28 includes a storage unit 29 which stores information S2, which indicates the rotation angle range of the rotary valve 58 corresponding to the second waiting period W2 (or low pressure gas sealing period L, and the same is applied hereinafter), in advance. The cryocooler control unit 24 may include a storage unit 70 which stores information, which indicates the rotation angle range of the rotary valve 58 corresponding to the second waiting period W2, in advance. The valve stop timing control unit 28 is configured so as to refer to the information stored in the storage unit 29 and/or the storage unit 70 as needed.

Figure 3:
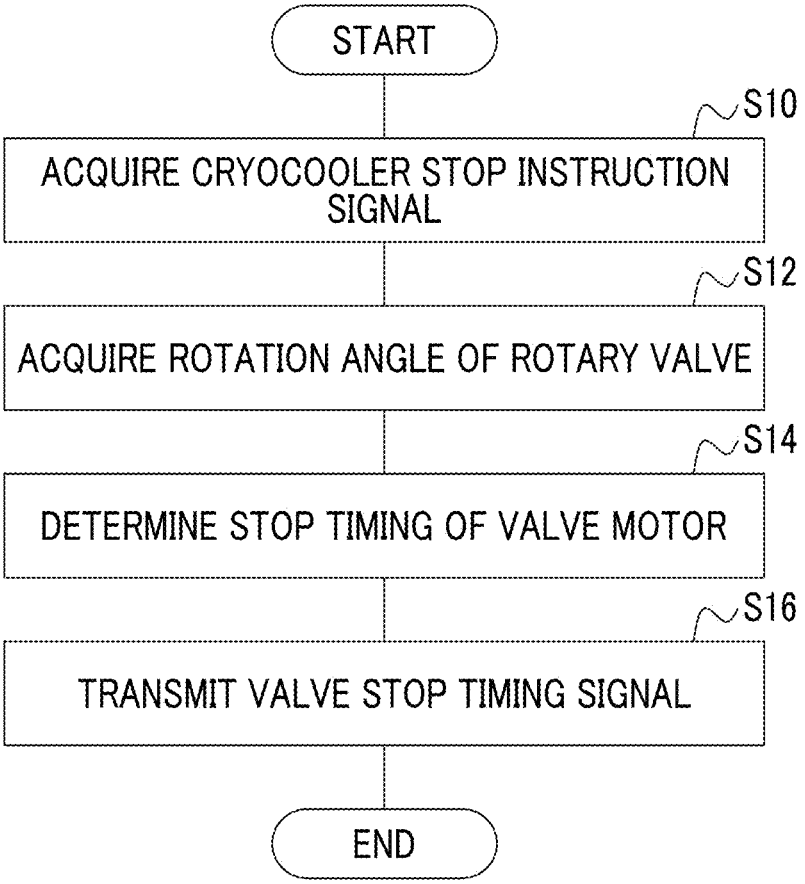
FIG. 3 is a flowchart exemplifying a control method of the cryocooler according to the first embodiment.

FIG. 3 is a flowchart exemplifying a control method of the cryocooler 10 according to the first embodiment. A control routine shown in FIG. 3 is initiated in response to an operation of the cryocooler stop instruction unit 26 by the operator. A cryocooler stop instruction signal S1 is output from the cryocooler stop instruction unit 26, and the cryocooler stop instruction signal S1 is input to the cryocooler control unit 24. The valve stop timing control unit 28 receives a cryocooler stop instruction signal S1 from the cryocooler control unit 24 through the power source line 30 and the first connector 72. In this way, the valve stop timing control unit 28 acquires the cryocooler stop instruction signal S1 (S10).

The valve stop timing control unit 28 receives a motor rotation angle signal S3 from the rotation angle sensor 62 through the power source line 30 and the second connector 74. The valve stop timing control unit 28 calculates the rotation angle of the valve motor 60, that is, the rotation angle of the rotary valve 58, from the received motor rotation angle signal S3. In this way, the valve stop timing control unit 28 acquires a current rotation angle of the rotary valve 58 (S12).

The valve stop timing control unit 28 refers to the information S2, which indicates the rotation angle range of the rotary valve 58 corresponding to the second waiting period W2, from the storage unit 29 or the storage unit 70. The valve stop timing control unit 28 determines the stop timing of the valve motor 60 such that the rotary valve 58 is stopped during the second waiting period W2, from the current rotation angle of the rotary valve 58 and the information S2 (S14).

For example, the valve stop timing control unit 28 determines a rotation angle to be rotated from the current rotation angle of the rotary valve 58 until reaching the rotation angle range of the rotary valve 58 corresponding to the second waiting period W2. The valve stop timing control unit 28 determines a point in time when the rotary valve 58 rotates from the current rotation angle by the rotation angle to be rotated, as the stop timing of the valve motor 60.

Alternatively, the valve stop timing control unit 28 determines a time required until reaching the rotation angle range of the rotary valve 58 corresponding to the second waiting period W2 from the current rotation angle of the rotary valve 58. The valve stop timing control unit 28 determines a point in time when this required time has elapsed from the present time, as the stop timing of the valve motor 60.

The valve stop timing control unit 28 outputs a valve stop timing signal S4 indicating the determined stop timing. The valve stop timing control unit 28 transmits the valve stop timing signal S4 to the cryocooler control unit 24, that is, the compressor control circuit 66 and the valve motor control circuit 68 (S16). In this way, the control routine in the valve stop timing control unit 28 ends.

The compressor control circuit 66 stops the power supply to the compressor motor 40 and the bypass valve 50 in accordance with the stop timing received from the valve stop timing control unit 28. Similarly, the valve motor control circuit 68 stops the power supply to the valve motor 60 in accordance with this stop timing. In this way, the compressor 12 and the valve unit 16 are stopped, and the cooling operation of the cryocooler 10 is completed.

In the compressor 12, the compression capsule 38 is stopped and the bypass valve 50 is opened. Since the high pressure flow path 42 and the low pressure flow path 44 communicate with each other, the pressure of the working gas inside the compressor 12 is an average pressure of the high pressure and the low pressure. Meanwhile, as described above, the rotary valve 58 is in the second waiting period W2 when the power supply is stopped. In this case, both the intake valve V1 and the exhaust valve V2 are closed, and the working gas pressure inside the cold head 14 becomes the low pressure.

In this way, the cryocooler 10 does not immediately stop the operation when the cryocooler 10 is instructed by the operator to stop the cooling operation. The cryocooler 10 continues the operation to a timing when the pressure of the working gas in the cold head 14 becomes the low pressure, and stops the operation at this timing.

Accordingly, the cryocooler 10 can stop the cooling operation when the pressure of the working gas in the cold head 14 is the low pressure. Therefore, the working gas pressure in the cold head 14 can be much lower than the working gas pressure in the compressor 12. For example, while the internal pressure of the compressor 12 is an average pressure of approximately 1.5 MPa, the internal pressure of the cold head 14 is approximately 0.8 MPa.

Accordingly, the cold head 14 can be fluidly disconnected from the compressor 12 when the cooling operation of the cryocooler 10 is stopped. Therefore, it is possible to suppress an excessive increase in the internal pressure when the temperature of the cold head 14 increases, and it is possible to decrease the risk to secure the safety in the maintenance of a component of the cryocooler 10, for example, the maintenance of the valve unit 16 and the cold head 14.

In addition, since the compressor 12 is installed in a room temperature environment, excessive increases in the temperature and the internal pressure as in the cold head 14 do not occur.

Figure 4:
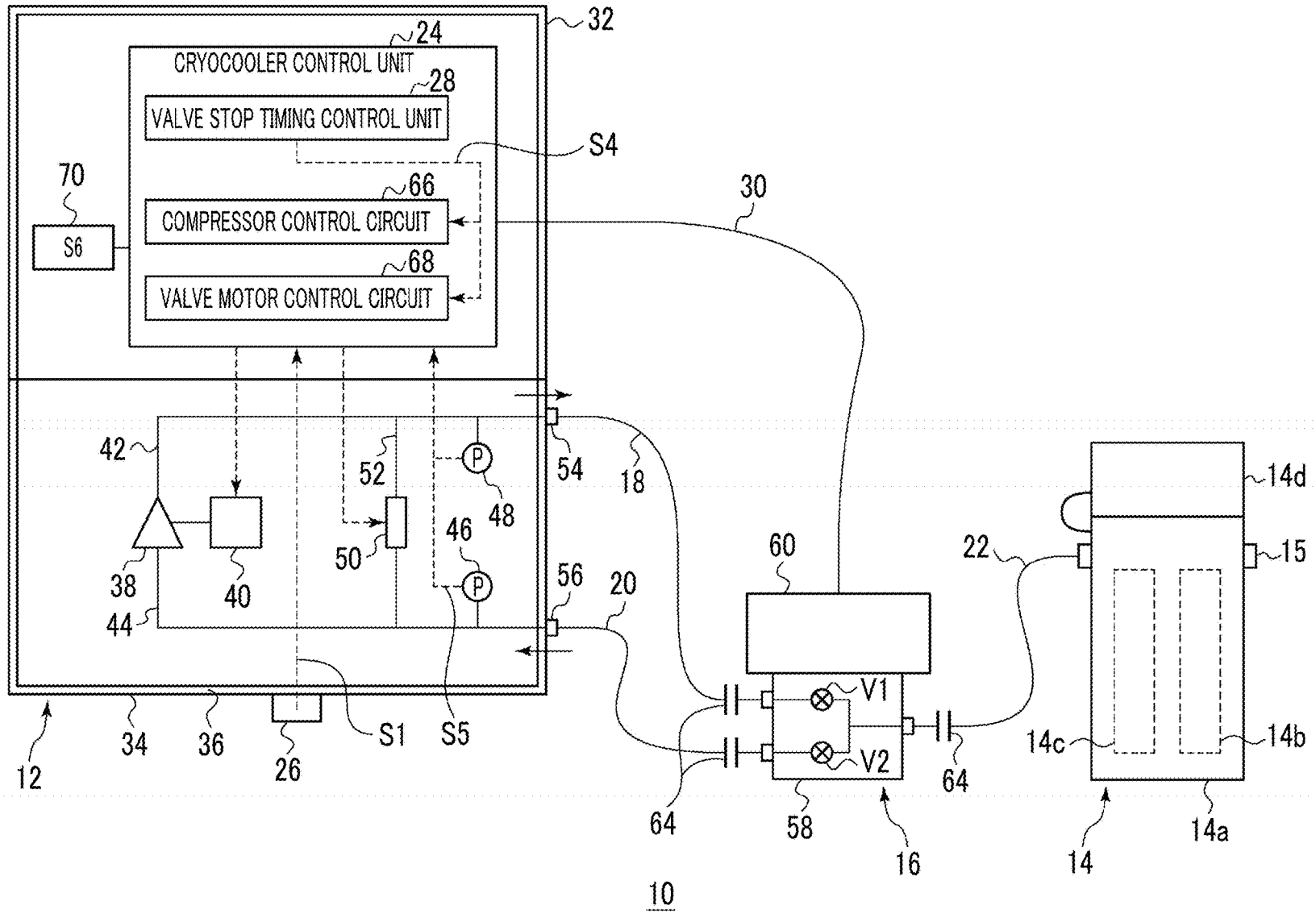
FIG. 4 is a diagram schematically showing an entire configuration of a cryocooler according to a second embodiment.

FIG. 4 is a diagram schematically showing an entire configuration of a cryocooler 10 according to a second embodiment. The cryocooler 10 according to the second embodiment is different from the cryocooler 10 according to the first embodiment in that the valve stop timing control unit 28 is accommodated in the compressor control board 32 and is provided in the cryocooler control unit 24. In addition, in the cryocooler 10 according to the second embodiment, the valve stop timing control unit 28 determines the stop timing of the valve motor 60, based on the pressure measured by the pressure sensor (for example, the first pressure sensor 46 and/or the second pressure sensor 48). In the following, in order to avoid redundancy, descriptions of the same configurations as those of the first embodiment are appropriately omitted.

As described above, the pressure of the working gas in the cold head 14 is periodically switched by the rotary valve 58, and thus, the pressure measured by the first pressure sensor 46 (or the second pressure sensor 48) also periodically varies. The measured pressure variation is correlated with the rotation angle of the rotary valve 58. Therefore, it is also possible to specify the rotation angle of the rotary valve 58, based on a pressure waveform measured by the first pressure sensor 46 (or the second pressure sensor 48).

As shown in FIG. 4, pressure waveform information S6 is stored in the storage unit 70 in advance. The pressure waveform information S6 indicates a relationship between the pressure and the time in one period of the refrigeration cycle. By referring to the pressure waveform information S6, the pressure measured by the first pressure sensor 46 (or second pressure sensor 48) can specify a required time until reaching a pressure range corresponding to the second waiting period W2 (or low pressure gas sealing period L, and the same is applied hereinafter) from the current pressure value.

Moreover, the cryocooler control unit 24 is electrically connected to the valve motor 60 by a power source line 30. Unlike the first embodiment, the valve stop timing control unit 28 is not provided in the power source line 30. The valve motor 60 may not include the rotation angle sensor 62.

Figure 5:
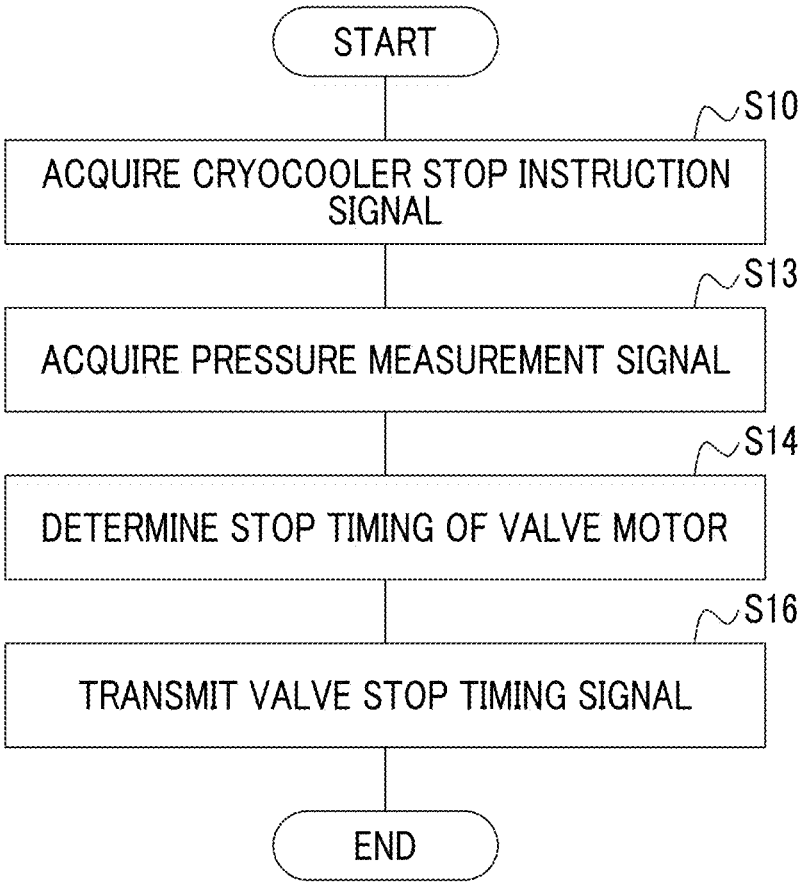
FIG. 5 is a flowchart exemplifying a control method of the cryocooler according to the second embodiment.

FIG. 5 is a flowchart exemplifying a control method of the cryocooler 10 according to the second embodiment. A control routine shown in FIG. 5 is initiated in response to an operation of the cryocooler stop instruction unit 26 by the operator. The cryocooler stop instruction signal S1 is output from the cryocooler stop instruction unit 26, and the cryocooler stop instruction signal S1 is input to the cryocooler control unit 24, that is, the valve stop timing control unit 28. In this way, the valve stop timing control unit 28 acquires the cryocooler stop instruction signal S1 (S10).

The cryocooler control unit 24 receives a pressure measurement signal S5 from the first pressure sensor 46 (or the second pressure sensor 48). The received pressure measurement signal S5 is input to the valve stop timing control unit 28. In this way, the valve stop timing control unit 28 acquires the pressure measurement signal S5 (S13). The pressure measurement signal S5 indicates the current pressure value.

The valve stop timing control unit 28 refers to the pressure waveform information S6 from the storage unit 70. The valve stop timing control unit 28 determines the stop timing of the valve motor 60 such that the rotary valve 58 is stopped during the second waiting period W2, from the current pressure value and the pressure waveform information S6 (S14). For example, the valve stop timing control unit 28 determines a time required for the current pressure value to reach the pressure range corresponding to the second waiting period W2. The valve stop timing control unit 28 determines a point in time when this required time has elapsed from the current time point, as the stop timing of the valve motor 60.

The valve stop timing control unit 28 outputs the valve stop timing signal S4 indicating the determined stop timing. The valve stop timing control unit 28 transmits the valve stop timing signal S4 to the compressor control circuit 66 and the valve motor control circuit 68 (S16). In this way, the control routine in the valve stop timing control unit 28 ends.

The compressor control circuit 66 stops the power supply to the compressor motor 40 and the bypass valve 50 in accordance with the stop timing received from the valve stop timing control unit 28. Similarly, the valve motor control circuit 68 stops the power supply to the valve motor 60 in accordance with this stop timing. In this way, the compressor 12 and the valve unit 16 are stopped, and the cooling operation of the cryocooler 10 is completed.

Similarly the first embodiment, also in the second embodiment, the cryocooler 10 continues the operation to the timing when the pressure of the working gas in the cold head 14 becomes the low pressure, and thus, it is possible to stop the operation at this timing.

Moreover, according to the second embodiment, unlike the first embodiment, the rotation angle sensor is not necessary to be provided in the valve motor 60, and thus, there is an advantage that the configuration of the valve unit 16 is simplified. However, similarly to the first embodiment, also in the second embodiment, the stop timing of the valve motor 60 may be determined based on the rotation angle measured by the rotation angle sensor.

Similarly to the second embodiment, also in the first embodiment, the valve stop timing control unit 28 may determine the stop timing of the valve motor 60, based on the pressure measured by the pressure sensor (that is, the first pressure sensor 46 and/or the second pressure sensor 48). In this case, as shown in FIG. 1, the cryocooler control unit 24 receives the pressure measurement signal S5 from the first pressure sensor 46 (or the second pressure sensor 48).

The pressure sensor which outputs the pressure measurement signal S5 to the valve stop timing control unit 28 may not be provided in the compressor 12. In an embodiment, the pressure sensor may be provided in the valve unit 16. Alternatively, the pressure sensor may be provided in the cold head 14.

It should be understood that the invention is not limited to the above-described embodiment, but may be modified into various forms on the basis of the spirit of the invention. Additionally, the modifications are included in the scope of the invention.

The cryocooler according to the embodiments is not limited to the pulse tube cryocooler. In an embodiment, the cryocooler may be a gas driven GM (Gifford-McMahon) cryocooler. In this case, the cold head includes a drive piston, a displacer, and a regenerator (not shown), and the displacer is driven by a gas pressure acting on a drive piston.

The present invention can be used in fields of a cryocooler and a control device of a cryocooler.

What is claimed is:

1. A cryocooler comprising:

a cold head;

a valve that comprises:

a rotary valve configured to periodically switch a pressure of a working gas in the cold head between a first high pressure and a second high pressure lower than the first high pressure, and a valve motor configured to rotate the rotary valve, the valve having a rotation angle range in which the rotary valve seals the working gas having the second high pressure in the cold head;

a cryocooler controller configured to control the valve motor;

a cryocooler stop instruction signal generator configured to output a cryocooler stop instruction signal to the cryocooler controller;

a rotation angle sensor configured to measure a rotation angle of the rotary valve; and a valve stop timing controller configured to:

control, according to the cryocooler stop instruction signal, the valve motor to stop the rotary valve in the rotation angle range, and determine, based on the rotation angle measured by the rotation angle sensor, a stop timing of the valve motor such that the rotary valve stops in the rotation angle range.

2. The cryocooler according to claim 1, wherein the valve stop timing controller is detachably configured between the valve motor and the cryocooler controller.

3. The cryocooler according to claim 1, wherein the valve stop timing controller is provided in the cryocooler controller.

4. A cryocooler comprising:

a cold head;

a valve that comprises:

a rotary valve configured to periodically switch a pressure of a working gas in the cold head between a first high pressure and a second high pressure lower than the first high pressure, and a valve motor configured to rotate the rotary valve, the valve having a rotation angle range in which the rotary valve seals the working gas having the second high pressure in the cold head;

a cryocooler controller configured to control the valve motor;

a cryocooler stop instruction signal generator configured to output a cryocooler stop instruction signal to the cryocooler controller;

a pressure sensor configured to measure a pressure of the working gas; and a valve stop timing controller configured to:

control, according to the cryocooler stop instruction signal, the valve motor to stop the rotary valve in the rotation angle range, and determine, based on the pressure measured by the pressure sensor, a stop timing of the valve motor such that the rotary valve stops in the rotation angle range.

5. The cryocooler according to claim 4, wherein the valve stop timing controller is detachably configured between the valve motor and the cryocooler controller.

6. The cryocooler according to claim 4, wherein the valve stop timing controller is provided in the cryocooler controller.

7. A control device of a cryocooler, the cryocooler comprising:

a cold head, a valve that comprises:

a rotary valve configured to periodically switch a pressure of a working gas in the cold head between a first high pressure and a second high pressure lower than the first high pressure, and a valve motor configured to rotate the rotary valve, the valve having a rotation angle range in which the rotary valve seals the working gas having the second high pressure in the cold head, a cryocooler controller configured to control the valve motor, a cryocooler stop instruction signal generator configured to output a cryocooler stop instruction signal to the cryocooler controller, and a rotation angle sensor configured to measure a rotation angle of the rotary valve, the control device comprising:

a valve stop timing controller configured to:

control, according to the cryocooler stop instruction signal, the valve motor to stop the rotary valve in the rotation angle range, and determine, based on the rotation angle measured by the rotation angle sensor, a stop timing of the valve motor such that the rotary valve stops in the rotation angle range.

8. The control device of according to claim 7, the valve stop timing controller is detachably configured between the valve motor and the cryocooler controller.

9. A control device of a cryocooler, the cryocooler comprising:

a cold head, a valve that comprises:

a rotary valve configured to periodically switch a pressure of a working gas in the cold head between a first high pressure and a second high pressure lower than the first high pressure, and a valve motor configured to rotate the rotary valve, the valve having a rotation angle range in which the rotary valve seals the working gas having the second high pressure in the cold head, a cryocooler controller configured to control the valve motor, a cryocooler stop instruction signal generator configured to output a cryocooler stop instruction signal to the cryocooler controller, and a pressure sensor configured to measure a pressure of the working gas, the control device comprising:

a valve stop timing controller configured to control, according to the cryocooler stop instruction signal, the valve motor to stop the rotary valve in the rotation angle range, and determine, based on the pressure measured by the pressure sensor, a stop timing of the valve motor such that the rotary valve stops in the rotation angle range.

10. The cryocooler according to claim 9, wherein the valve stop timing controller is detachably configured between the valve motor and the cryocooler controller.

* * * * *